US005839648A

United States Patent [19]

Brigand et al.

[11] Patent Number: 5,839,648

[45] Date of Patent: Nov. 24, 1998

[54] DEVICE FOR EASY OPENING OF FLEXIBLE FILM PACKAGING HAVING A LINE OF WEAKNESS; A PACKET CONSTITUTED BY A CONTENTS AND PACKAGING PROVIDED WITH SUCH A DEVICE; AND AN EASY OPENING PATCH FOR SUCH A DEVICE

[75] Inventors: Jean-Luc Brigand, Gan; Jean-Luc Sornay, Bailly, both of France

[73] Assignees: Bongrain S.A., Guyancourt; Grace S.A., Epernon, both of France

[21] Appl. No.: 663,718

[22] Filed: Jun. 14, 1996

[30] Foreign Application Priority Data

Jun. 14, 1995 [FR] France ..... 95 07086

[51] Int. Cl.[6] ..... B65D 33/00

[52] U.S. Cl. ..... 229/87.05; 383/35; 383/66; 383/205; 383/206; 383/210

[58] Field of Search ..... 40/310, 311, 312; 383/205, 206, 210, 211, 35, 78, 61, 66; 229/87.05

[56] References Cited

U.S. PATENT DOCUMENTS

| | | | |
|---|---|---|---|
| 1,587,280 | 6/1926 | Burke . | |
| 1,827,636 | 10/1931 | Ames | 206/813 |
| 2,091,346 | 8/1937 | Wright | 40/310 |
| 2,172,455 | 9/1939 | Samuel | 383/210 |
| 2,262,111 | 11/1941 | Moore | 383/210 |
| 2,517,801 | 8/1950 | Roush | 229/87.05 |
| 2,699,286 | 1/1955 | Geffroy | 383/206 |
| 2,745,754 | 5/1956 | Steinbock | 383/211 |
| 3,187,982 | 6/1965 | Underwood et al. | 383/205 |
| 3,379,360 | 4/1968 | Crossley | 383/66 |
| 3,469,364 | 9/1969 | Bischoff | 53/469 |
| 4,640,411 | 2/1987 | Fery | 383/206 |
| 4,679,693 | 7/1987 | Forman | 383/205 |
| 4,902,142 | 2/1990 | Lammert et al. | 383/78 |
| 5,035,518 | 7/1991 | McClintock | 206/813 |
| 5,207,458 | 5/1993 | Treichel et al. | 40/310 |
| 5,588,239 | 12/1996 | Anderson | 40/310 |

FOREIGN PATENT DOCUMENTS

| | | |
|---|---|---|
| 0 579 030 | 1/1994 | European Pat. Off. . |
| 883408 | 11/1961 | United Kingdom . |

*Primary Examiner*—Stephen P. Garbe
*Attorney, Agent, or Firm*—Young & Thompson

[57] ABSTRACT

An easy opening device specifically adapted to packaging of flexible film (3) having a line of weakness in tearing (4), the device being characterized in that it comprises a patch (5) that is flexible and substantially inextensible such as a label, a membrane, or a piece of film, which patch is applied to the outside face of the film (3) astride the line of weakness (4), and includes, over said line (4), separation means (6) for separating the patch (5) into two parts (7*a*, 7*b*), which means are normally inactive when the packaging (3) is closed and are made active by the user exerting sufficient traction; means (8) for bonding the film (3) to the patch (5) on either side of the line of weakness (4) and in register with the two parts (7*a*, 7*b*); and means (9) for enabling at least one of the two parts (7*a*, 7*b*) to be grasped manually so as to make it possible, once the separation means (6) have been activated, to move the two parts (7*a*, 7*b*) apart from each other and open the packaging.

17 Claims, 4 Drawing Sheets

DEVICE FOR EASY OPENING OF FLEXIBLE FILM PACKAGING HAVING A LINE OF WEAKNESS; A PACKET CONSTITUTED BY A CONTENTS AND PACKAGING PROVIDED WITH SUCH A DEVICE; AND AN EASY OPENING PATCH FOR SUCH A DEVICE

BACKGROUND OF THE INVENTION

The invention relates to a device for easy opening of flexible film packaging having a line of weakness in tearing; a packet constituted by a contents and packaging provided with such a device; an easy opening patch for such a device; a method of making such a packet; a method of making packaging film provided with an easy opening patch; and a tubular film made thereby.

DESCRIPTION OF THE RELATED ART

PCT publication WO-A-87/07580 discloses an assembly comprising a container for receiving a substance and a label. The assembly makes it possible to disperse the substance. The container has a flap which opens by pivoting about a hinge-forming line. The label is provided with a permanent adhesive completely covering the flap and beyond its hinge-forming line. Thus, the label is permanently associated with the flap and the container beyond the hinge-forming line. The label is also provided with a fine and light pattern of adhesive surrounding the flap and constituting means for association with the container to close the flap. According to that publication, provision is also made, opposite the flap, for the label to be completely covered in permanent adhesive. Adjacent to said portion a rip-cord is provided. The problem on which that publication is based is therefore that of closing the container—specifically a cardboard box—after each use thereof, by means of a label that serves simultaneously over one portion to provide a permanent link and over another portion to provide a link that is repetitively releasable.

European patent publication EP-A-517 566 relates to a label for closing a packet in which the free edges of the envelope are brought together, and folded over or down. In one of the embodiments envisaged, the label also makes successive opening and closing possible.

Packets are also known that are constituted by a contents and packaging made of flexible film that is sealed to itself. Such a situation is to be found, for example, in the food industry, for pre-packaged parts of cheeses or speciality cheeses, or boxes of sweets or other confectionery, or for non-food products, such as stationary.

In such a situation, the flexible film includes one or more lines of sealing. For example, it may be sealed by ultrasound, by heat, or electrostatically.

More particularly, the packet may be of the type in which the film is placed under tension over the contents by mechanical means, or it may be tensioned over the contents by a heat-shrinking step. Under such circumstances, it is generally difficult to tear the film to gain access to the contents. The film provides no purchase to get hold of.

SUMMARY OF THE INVENTION

The invention seeks to remedy those drawbacks, and in a first aspect it provides an easy opening device specifically adapted to packaging of flexible film having a line of weakness in tearing, the device being characterized in that it comprises a patch that is flexible and substantially inextensible such as a label, a membrane, or a piece of film, which patch is applied to the outside face of the film astride the line of weakness, and includes, over said line, separation means for separating the patch into two parts, which means are normally inactive when the packaging is closed and are made active by the user exerting sufficient traction; means for bonding the film to the patch on either side of the line of weakness and in register with the two parts; and means for enabling at least one of the two parts to be grasped manually so as to make it possible, once the separation means have been activated, to move the two parts apart from each other and open the packaging.

In a first embodiment, the patch is in one part, in which case it includes said separation means. In a second embodiment, the patch is in two parts, with a separation between them, and it does not include separation means.

In a second aspect, the invention also provides a packet constituted by a contents and by packaging provided with such an easy opening device.

In a third aspect, the invention provides an easy opening patch for the above-mentioned device, and characterized, in a first embodiment, in that it is flexible, substantially inextensible, and includes separation means for separating it into two parts, each part comprising two portions, namely a first portion adjacent to the separation means being provided with bonding means for bonding it to the film or being suitable for being bonded to the film by such means, and a second portion adjacent to the first portion and to the free edge of the patch, having no such means for bonding it to the film or being unsuitable for being bonded to the film, or bonded to the film while remaining easily separable therefrom.

In a second embodiment, the patch in question is characterized in that it has no separation means and is made in two parts.

In a fourth aspect, the invention provides a method of making packaging film, starting from a film that is shaped to form a tube which is provided with a longitudinal seal, a patch for easy opening of the packaging is applied to the outside face of the film in such a manner as to position the separation means of the patch or the separation between the two parts of the patch in register with the line of sealing made on the film, and the two parts of the patch are bonded to the film, in particular by applying pressure between the parts and the film, the patch being applied on either side of a portion of weakness in the line of sealing or adhesive of the film.

Consequently, and in a fifth aspect, the invention provides a tubular film characterized by the fact that it includes a plurality of spaced-apart easy opening patches.

In a sixth aspect, the invention provides a method of making a packet in which the contents is enveloped in the film, which film is provided with an easy opening device.

In a first embodiment, the easy opening patch is applied to the film after the film has been put into place and closed on the contents.

In a second embodiment, the starting material is a film shaped into a tube, and provided both with a longitudinal seal and with an easy opening patch; the contents is placed in a cutoff length of the tubular film; and the tubular film is closed onto itself.

The invention thus makes it possible to make an easy opening for flexible film packaging having a line of weakness (sealing, adhesive, or other).

BRIEF DESCRIPTION OF THE DRAWINGS

The invention will be well understood from the following description given with reference to the accompanying drawings, in which.

DESCRIPTION OF THE PREFERRED EMBODIMENTS

Figure 1:
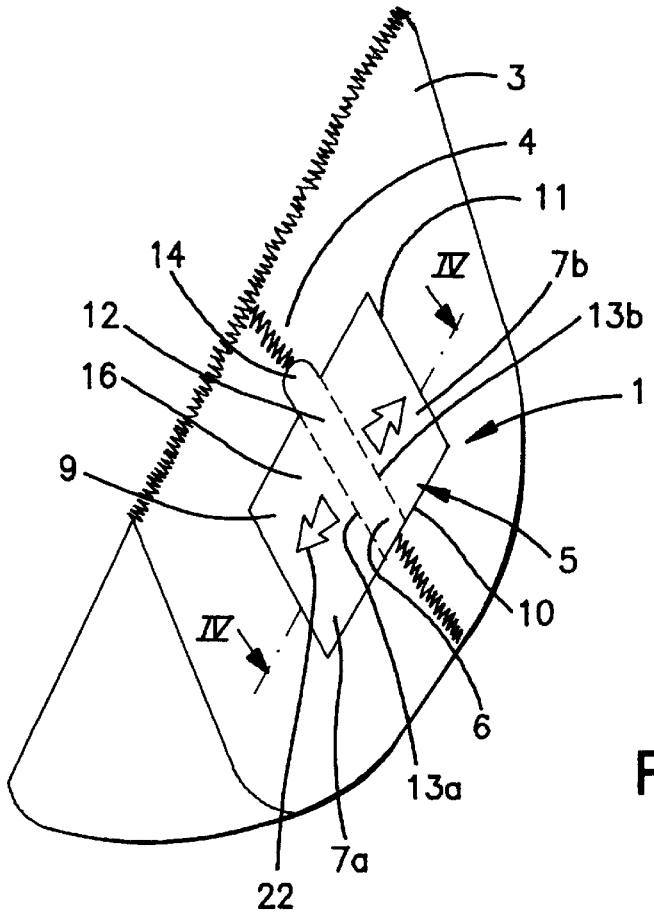
FIG. 1 is a perspective view of a packet including flexible film packaging provided with an easy opening device of the invention with a patch in a single part.
Figure 4:
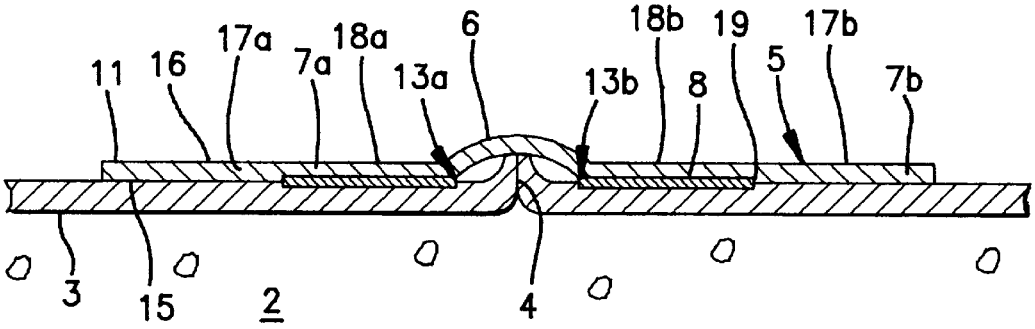
FIG. 4 is a diagrammatic section view on a larger scale on line IV—IV of FIG. 1.

Reference is now made more particularly to FIGS. 1 and 4 which shows a packet 1 constituted by a contents 2 and packaging 3.

By way of example, the contents 2 may be in the form of a block of cheese or of speciality cheese. However, this application is not limiting in any way.

The packaging comprises essentially a flexible film of plastics material. The film may be non-oriented, mono-oriented, or bi-oriented. It may be stretchable, heat-shrinkable, or heat-set, it may be transparent or opaque, it may optionally be printed, and where appropriate, it may be of food grade.

The plastics materials used and the methods of producing such films can therefore be selected, in particular, from those which are known in this field, that are optimized for obtaining the above-mentioned desired properties, and that are suitable for the particular application. The outer layers thereof must be suitable for being sealed, glued or joined, and bonded one to the other by electrostatic sealing, with materials that are suitable, in non-limiting manner, including polyolefins and polyamides.

The film is closed onto itself by means of one or more lines of sealing 4 which may be of the ultrasound seal, or the heat-seal, or the electrostatic seal type.

Sealing is preferably performed by ultrasound.

In a variant, the film is closed by adhesive.

The term "line of weakness" is used to cover all the various different embodiments.

The film 3 has a line of weakness in tearing. A line of sealing 4 naturally satisfies this condition. Where appropriate, a special portion of a line of sealing 4 may be provided that is weaker in tearing than is the remainder of the line of sealing.

The easy opening device of the invention also comprises an easy opening patch 5.

The patch 5 is in the form of a label, a membrane, or a piece of film. The patch 5 is flexible but substantially inextensible when manual traction is exerted by the user. The patch 5 is made of or from paper, plastics material, card, or a combination of such materials.

The patch 5 is applied to the outside face of the film 3 of the packaging, i.e. on its face not in contact with the contents.

The patch 5 is placed astride the line 4 of weakness in the film 3.

In the description below, this line of weakness is assumed to be a line of sealing 4 or more particularly a portion in a line of sealing 4 that is of even greater weakness.

The patch 5 in the embodiment of FIG. 1 comprises a single part and it has means 6 for separation into two parts 7*a* and 7*b*. Consequently, the patch 5 is made of a material of a kind or shape that is suitable for enabling such separation to take place.

The separation means 6 are normally inactive while the packaging 3 is closed. They are made active by the user exerting sufficient traction on said means.

When the separation means 6 are inactive, the two parts 7*a* and 7*b* of the patch 5 are "united" stays.

In contrast, when the packaging 3 is opened, the separation means 6 are active and the two parts 7*a* and 7*b* are distinct and spaced apart from each other.

Figure 6:
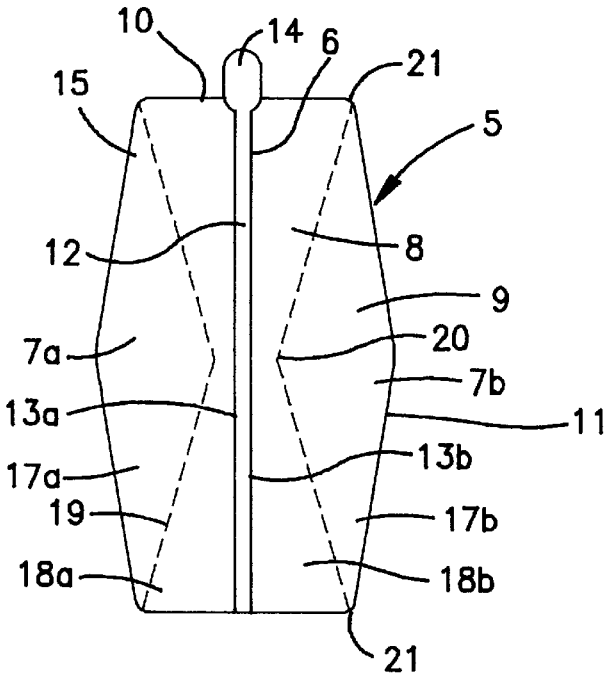
FIG. 6 is an elevation view of one possible embodiment of an easy opening patch.
Figure 2:
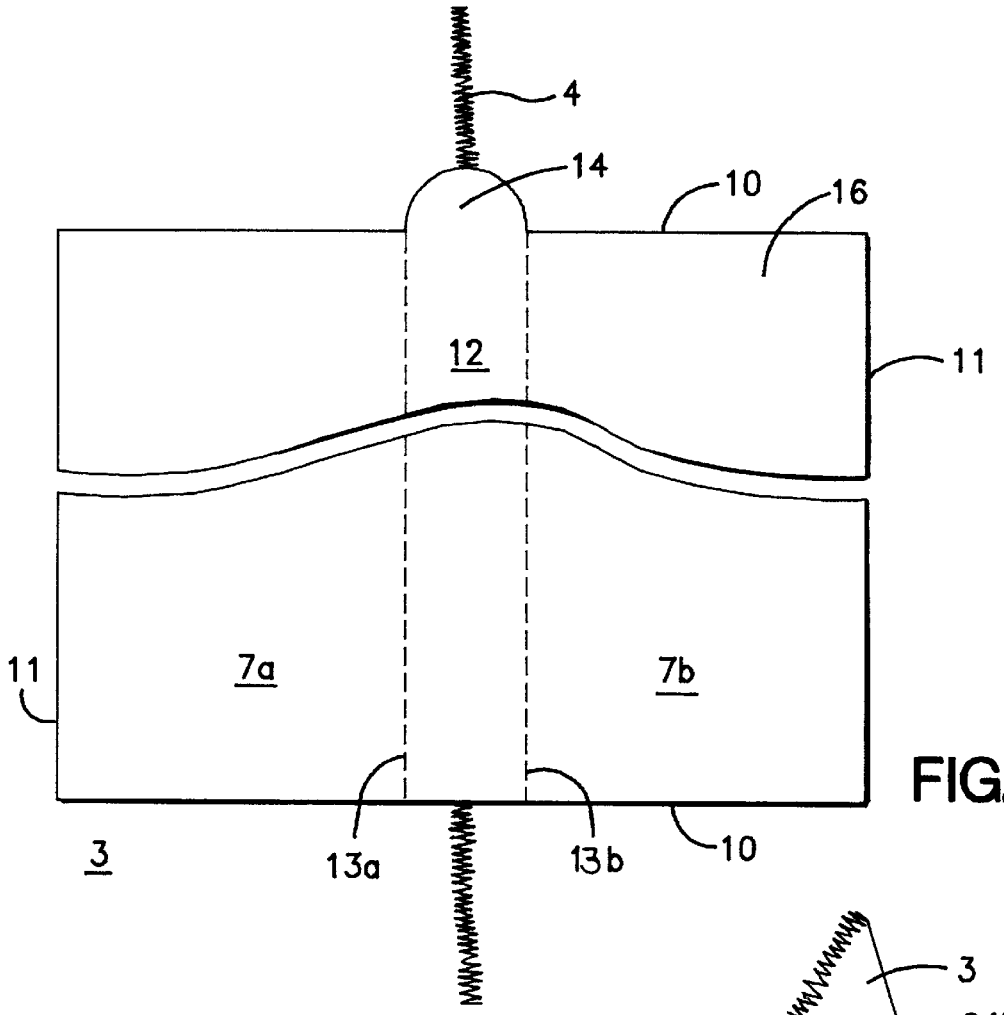
FIG. 2 is a fragmentary diagrammatic view on a larger scale of the device shown in FIG. 1.

The easy opening device also comprises means 8 for bonding the film 3 to the patch 5 on either side of the line of weakness 4 in register with the two parts 7*a* and 7*b*. These means 8 are shown in FIGS. 4 and 6, in particular.

These bonding means 8 may be adhesive or sealing. For example, the patch 5 may be manufactured with adhesive situated over a portion thereof or having an appropriate configuration, as described below.

The easy opening device also comprises means 9 on at least one of the two parts 7*a* and 7*b* and suitable for being grasped manually by the user.

The grasping means 9 are such as to be suitable, once put into operation after the separation means 6 have been activated, for enabling the two parts 7*a* and 7*b* to be pulled apart, thereby opening the packaging 3 along the line of weakness 4.

In the embodiment shown in the drawings, the patch 5 is generally rectangular or pseudo-rectangular, being defined by two transverse free edges 10 and two longitudinal free edges 11.

In the particular embodiment shown in FIG. 6, the patch 5 is generally lozenge-shaped with its sharper angles being truncated to form the transverse free edges 10.

In this case, each of the longitudinal free edges 11 thus comprises two segments at an angle.

In the embodiment shown in the drawings, the patch 5 has a plane of longitudinal symmetry.

In a particular embodiment shown in the drawings, the separation means 6 are in the form of a tongue 12.

The tongue 12 is integral with the patch 5 but is suitable for being torn off. It extends from one of its transverse free edges 10 to the other.

The tongue 12 is interposed between and defines the two parts 7*a* and 7*b*. It is separated from them by two respective lines of weakness 13*a* and 13*b*.

Consequently, the part 7*a* is bounded towards the center of the patch 5 by the line of weakness 13*a*; towards the outside of the patch 5 by the corresponding longitudinal free edge 11; and at each of its two ends by the transverse free edges 10.

A symmetrical situation applies to the part 7*b*.

The lines of weakness 13*a* and 13*b* may be continuous or discontinuous. They may be made by scoring, punching, piercing, or in any other appropriate manner. These lines are preferably rectilinear.

At at least one of its two ends, the tongue 12 has a grasping portion 14 that projects from the transverse free edge 10 of the patch. This portion 14 may be of increased width so as to provide sufficient purchase for the user, given that the tongue 12 may itself be narrow.

In another embodiment, not shown, the separation means 6 comprise one or more lines of weakness formed in the patch 5 and extending from one of the two edges 10 to the other. The line(s) of weakness is/are broken by the user acting either directly on the line(s) or indirectly via the bonding means 8.

In another embodiment, not shown, the separation means 6 are in the form of at least one thread, tape, or the equivalent, applied to the face 15 of the patch 5 that faces the film 3. This face 15 is referred to as the "inside" face. It faces the contents 2 and is normally invisible to the user when the packaging 3 is closed. In contrast, the opposite face 16 of the patch 5 is an outside face that is visible to the user.

The thread, tape, or equivalent extends from one of the two transverse free edges 10 to the other, being interposed between the two parts 7*a* and 7*b*.

The thread, tape, or equivalent includes a portion for grasping that emerges from the patch 5 in such a manner as to enable the user to take hold of it and then apply traction. By applying sufficient traction to the thread, tape, or equivalent, it is then possible to tear through the patch 5.

In the vicinity of the line of weakness 4 and the separation means 6, the film 3 and the patch 5 are not bonded together by adhesive, sealing, or other means or they are bonded together but only with a force much weaker than the force bonding each of the parts 7*a* and 7*b* to the film 3.

Consequently, separation of the patch 5 into two distinct parts 7*a* and 7*b* is not prevented by any such bonding of the patch 5 to the film in the vicinity of the line of weakness 4 and the separation means 6.

This lack of bonding between the patch 5 and the film 3 in the vicinity of the line of sealing 4 is not any kind of drawback, particularly since the line of weakness 4 may include projections. Where appropriate, the patch 5 is curved in this location.

Figure 7:
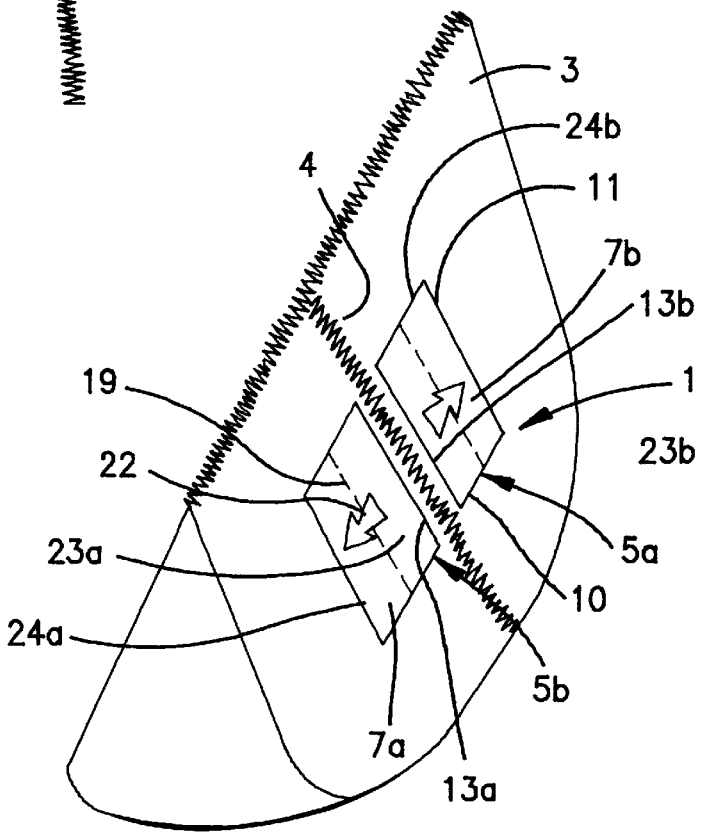
FIG. 7 is a view similar to FIG. 1 showing another variant embodiment with a patch that is in two separate parts.
Figure 3:
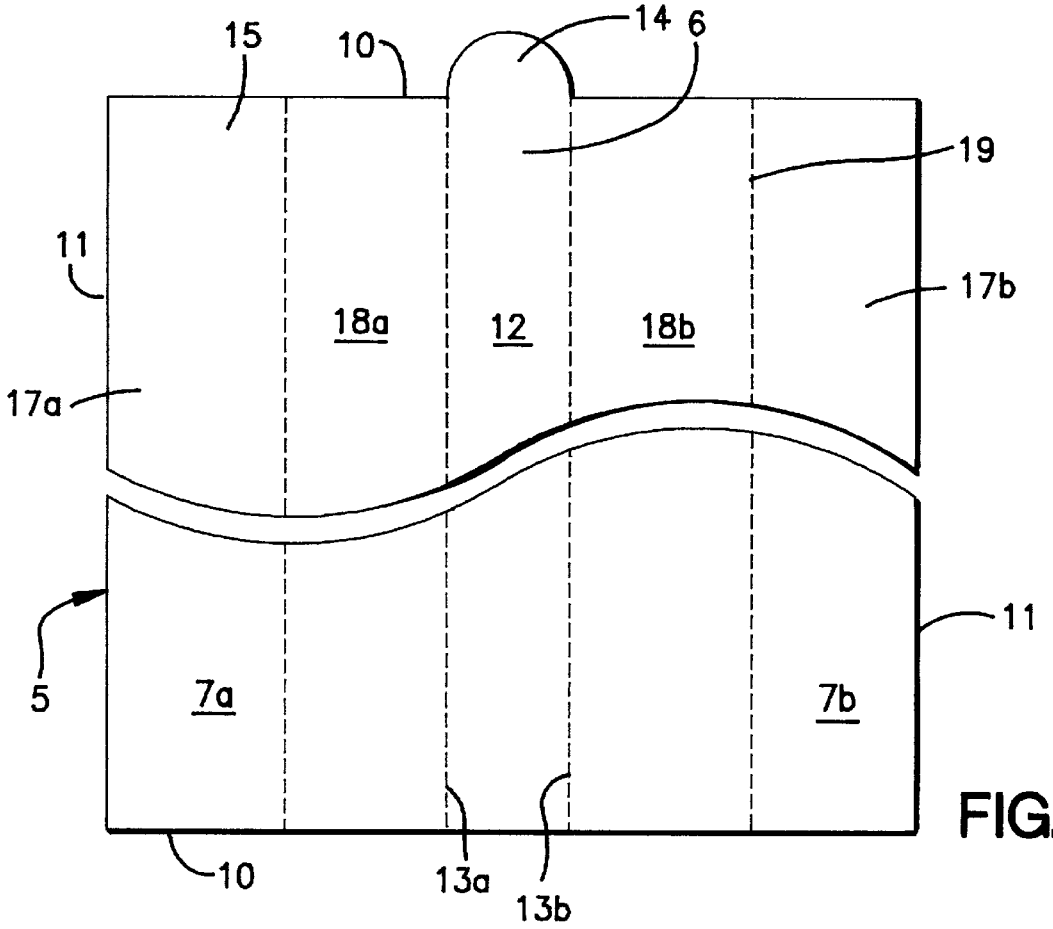
FIG. 3 is a bottom view of the easy opening patch shown in FIG. 2.

In another possible embodiment of the invention, as shown in FIG. 7, the one-part patch 5 described above is replaced by a patch 5 in two parts 5*a* and 5*b* that are preferably symmetrical and placed symmetrically about the line of weakness 4 and that are fixed to the packet 1, i.e. to the outside face of the film 3. The parts are physically not united. The parts 5*a* and 5*b* are assembled on the packet 1, preferably simultaneously, but they are separate from each other and placed on either side of the line of weakness 4. These two parts 5*a* and 5*b* replace the one-part patch 5 described above. The function of this embodiment is identical to that described above with the exception of the separation means 6 comprising the tongue 12 and the grasping portion 14 which are omitted. Consequently, the two parts 5*a* and 5*b* are flexible and substantially inextensible. The two parts 5*a* and 5*b* are normally inactive when the packaging 3 is closed, and they are made active by the user exerting sufficient traction Means 23*a* and 23*b* bond the film 3 to each of the two parts 5*a* and 5*b* of the patch on either side of the line of weakness 4. Manual grasping means 24*a* and 24*b* are suitable, once readied for use, for moving the two parts 5*a* and 5*b* apart and thus opening the packaging.

In the variant shown in the drawings where the separation means 6 comprises a tongue 12, the width of the tongue is preferably sufficient to cover appropriately the seal of the line of weakness 4.

In general, the grasping means 9 are constituted by a portion 17 of each of the parts 7*a* and 7*b*. The characteristic of the portion 17 is that it is not bonded to the film 3 or at least that it is easily separated from the film 3. For example, a spot of adhesive may be provided between the portion 17 of the patch 5 and the film 3 for the purpose of preventing the portion 17 of the patch 5 being moved away from the film 3 too soon.

Each of the two parts 7*a* and 7*b* of the patch 5 thus comprises at least a first portion 18 adjacent to the separation means 6 and a second portion 17 adjacent to the first portion 18 and forming the means 9. The two portions 17 and 18 are joined together by a line 19. The line 19 may be embodied as such, or else it may be constituted merely by the boundary between the portions 17 and 18.

The first portion 18 is bonded to the film 3 by the bonding means 8. This first portion 18 is bounded towards the center of the patch 5 by one of the lines of weakness 13*a* and 13*b*; towards the outside of the patch 5 it is bounded by a line such as 19; and at its ends it is bounded by the edges 10.

The second portion 17 is bounded towards the inside of the patch 5 by a line such as 19. It is adjacent to one of the free edges 11 of the patch. Where appropriate, its ends are bounded by the transverse free edges 10.

In the embodiment of FIG. 6, the line 19 has at least one portion 20 close to the separation means 6 and in particular close to the corresponding line of weakness 13*a*, 13*b*, and at least one portion 21 that is further away from the separation means 6. However, this embodiment does not exclude others.

In the embodiment of FIG. 6, the portion 20 is situated in the middle part of the patch 5 at substantially equal distances from the edges 10. In this variant, two further away portions 21 are provided adjacent to the two edges 10.

Preferably, and when the patch 5 is symmetrical or substantially symmetrical about the separation means 6, each of the two parts 7*a* and 7*b* includes manual grasping means such as 9.

A patch 5 as described above may be made of plastics material, in particular a material based on polyolefin or a laminate based on polyamide. It may equally well be made of paper or of card. It may be a laminate.

In one possible embodiment, the patch 5 also constitutes a label for the packet 1 and to this end it receives printing 22 that is informative, decorative, functional, or that constitutes advertising. The printing may include instructions on how to use the easy opening device, e.g. in the form of arrows (see FIG. 1).

In an aspect of the invention concerning manufacture of packaging film, the starting material is a film 3 shaped to form a tube and provided with a longitudinal line of sealing or adhesive 4, and a patch 5 for easy opening of the packaging is applied to the outside face of the film 3 so as firstly to position the separation means 6 of the patch 5 or the separation between the two parts 5*a* and 5*b* of the patch 5 in register with the line of sealing or adhesive 4 in the film, and secondly to bond the two parts 7*a* and 7*b* of the patch 5 to the film 3 in particular by applying pressure between the parts and the film, the patch 5 being placed over and on either side of a portion of weakness in the line of sealing or adhesive 4 of the film 3.

In this embodiment, the film is made before being put into place around the contents to be packaged.

Preferably, and in the context of an industrial process, a plurality of easy opening patches 5 are placed on the film 3, being spaced apart at appropriate intervals as a function of the packaging to be performed.

The film 3 provided with easy opening patches 5 is wound up for subsequent use.

The invention also relates to the tubular film produced by the method.

A method of making a packet 1 as described above is such that the contents 2 is enveloped in the film 3.

In a first possible implementation, the contents 2 is initially enveloped in the film 3 which is not already provided with an easy opening device, and then the film 3 is closed onto itself, in particular by sealing or adhesive, and in particular by an ultrasound sealing technique, after which the film is optionally heat-shrunk to press the film 3 around the contents 2.

Thereafter, with the film 3 put into place and closed in this manner, an easy opening patch such as 5 is applied to its outside face.

In a second possible implementation, the starting material is a tubular film 3 provided with a longitudinal seal or a longitudinal line of adhesive 4 together with an easy opening patch, as obtained from the above-described method of making a tubular film 3 with patches.

During packaging, the roll of film is unwound over the desired length of tube 3 corresponding to the predetermined distance over which the easy opening device has been placed, and the film is cut to length. The contents 2 to be packaged is then placed inside the cutoff length of tubular film 3. Finally, the openings of the tubular film 3 are sealed or stuck together, it being possible to pump out air before the final closure step.

The patch 5 is placed in such a manner as firstly to position the separation means 6 in register with the line of sealing or adhesive 4, and secondly to bond the two parts 7*a* and 7*b* to the film 3, in particular in the portions 18.

In order to make opening even more easy, the patch 5 is applied over a portion of weakness in the line of sealing or adhesive of the film 3.

An easy opening patch for the above-described device thus has the following characteristics in one of the embodiments considered: it is flexible but substantially inextensible and it is in the form of a label, a membrane, or a piece of film. It includes separation means 6 for separating it into two parts 7*a* and 7*b*.

Each part 7*a* and 7*b* has two portions: a first portion 18 and a second portion 17. For the part 7*a*, these portions are referenced 17*a* and 18*a*. For the part 17*b*, they are referenced 17*b* and 18*b*.

The portions 18*a* and 18*b* adjacent to the means 6 are bonded to the film 3 by the bonding means 8. The portions 17*a* and 17*b* are adjacent to the portions 18*a* and 18*b* respectively and also to respective longitudinal free edges 11 of the patch 5. They are not bonded to the film 3, or they are easily separable therefrom. Consequently, in the portions 18*a* and 18*b*, the patch 5 does not have bonding means 8 of the kind that it does have in the portions 17*a* and 17*b*.

As mentioned above, the patch 5 may also be embodied as shown in FIG. 7 whereby it is embodied by two separate parts, in which case it does not include any separation means 6.

In this case, in addition to the embodiments described above in which (i) it is possible to place the two parts of the patch 5 on the film 3 after it is enveloped around the contents 2 or (ii) it is possible to place the two parts of the patch 5 on a film 3 shaped to form a tube and provided with a longitudinal seal or a longitudinal line of adhesive, it is also possible to provide for the two parts of the patch 5 to be applied to a film 3 while it is flat, the parts being applied at regular intervals in such a manner that when the roll of flat film is unwound and the film is shaped around the contents 2 during packaging, and the film is closed by longitudinal sealing or by a longitudinal line of adhesive, the two parts of the patch 5 come to face each other on either side of the line of sealing or of adhesive in the film so as to enable it to be opened easily in accordance with the present invention.

To open a packet as described above, the procedure is as follows:

Firstly the separation means 6, if any, are activated. For example, the grasping portion 14 is grasped and pulled while the packet 1 is held elsewhere so as to tear off the tongue 12 along the lines of weakness 13*a*, 13*b*.

Once that has been done, the patch 5 comprises two distinct parts 7*a* and 7*b*.

It should be observed that tearing off the tongue 12 does not enable the patch 5 to be separated from the film 3 in the portions 17*a* and 17*b*, given that the bonding means 8 are still active and secure the patch 5 sufficiently to the film 3.

Figure 5A:
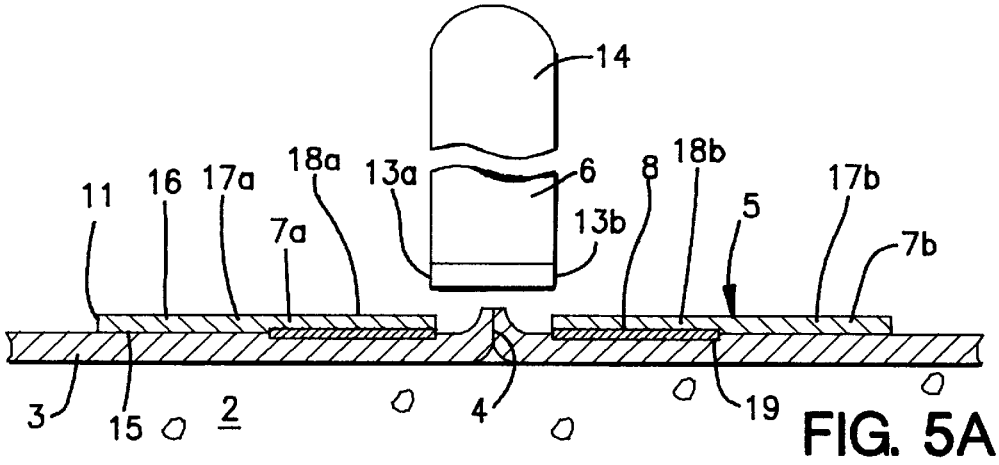
FIGS. 5A, 5B, 5C, and 5D are diagrammatic section views corresponding to FIG. 4 and showing the successive steps in opening the packaging.

This step of using the separation means 6 is shown diagrammatically in FIG. 5*a*.

Figure 5B:
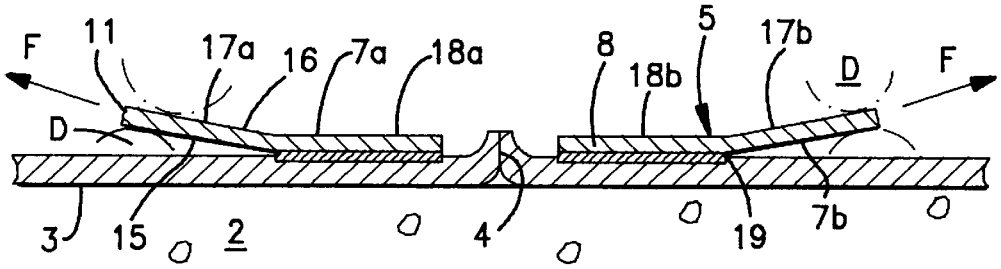
Figure 5C:
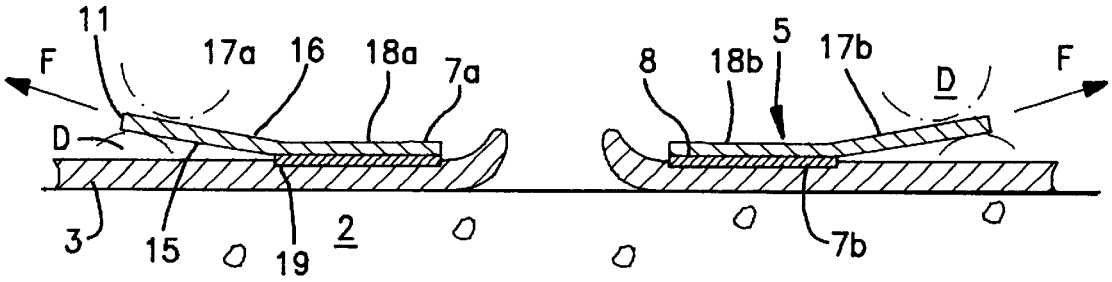
Figure 5D:
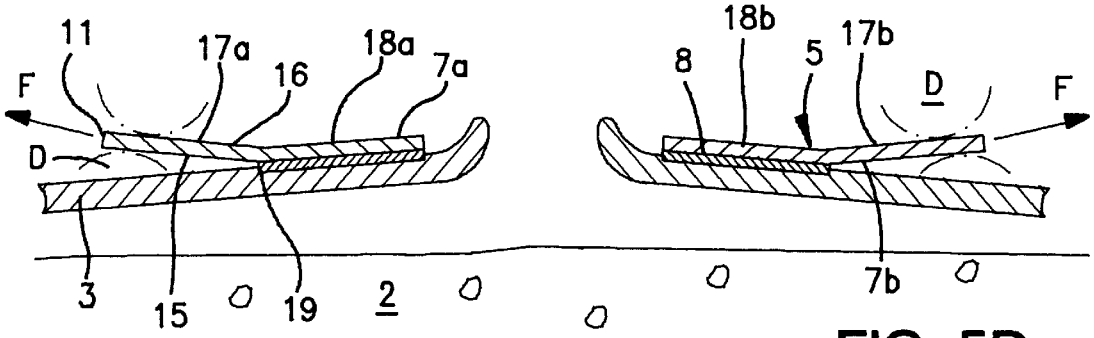

Thereafter, the user can take hold of the grasping means 9, i.e. the portions 17*a* and 17*b*. This is done, for example, between the index fingers and thumbs of the user, as shown diagrammatically in FIG. 5*b* under Reference D.

The portions 17*a* and 17*b* are that much easier to take hold of given that they are not bonded to the film 3 or they are only weakly bonded thereto, as mentioned above.

The user can then pull on the two parts 7*a* and 7*b* in the directions of arrows F (FIG. 5) in order to separate them from each other.

This operation is made that much easier given that the patch 5 is somewhat flexible thus enabling it to be folded or curved at the lines 19.

Then (FIG. 5*c*), the user can break the line of weakness 4 by continuing to apply traction in the direction for moving the two parts 7*a* and 7*b* away from each other. This is made possible because the bonding force exerted by the bonding means 8 is considerably stronger than the force bonding the two parts of the film 3 along the line of sealing 4.

Finally, by continuing to apply the above-mentioned traction, the user can progressively separate the film 3 from the contents 2 so as to disengage the contents completely.

In the variant embodiment of FIG. 7, the procedure is the same as above, with exception of the initial step of tearing off the tongue 12 (FIG. 5*a*).

What is claimed is:

1. In combination, an easy opening device and flexible film, serving as packaging, having a line of weakness in tearing, the device comprising a patch that is flexible and substantially inextensible, in the form of a label, which patch is applied to an outside face of the film astride the line of weakness, and includes, over said line, separation means for separating the patch into two parts, which means are normally inactive when the packaging is closed and are made active by the user exerting sufficient pulling force; means for bonding the film to the patch on either side of the line of weakness and in register with the two parts; and means for enabling at least one of the two parts to be grasped manually so as to make it possible, once the separation means have been activated, to move the two parts apart from each other and open the packaging.

2. The combination according to claim 1, wherein the separation means are in the form of a tongue suitable for tearing off, which tongue is integral with the patch, extending from one of two opposite free edges to the other and being interposed between its two parts and being joined to them by two lines of weakness.

3. The combination according to claim 2, wherein the tongue includes, at at least one end, a grasping portion projecting from the free edge of the patch.

4. The combination according to claim 1, wherein the film and the patch are bonded together in the vicinity of the line of weakness of the film and the separation means of the patch but with a force that is considerably smaller than the force bonding each part of the patch with the film.

5. The combination according to claim 1, wherein the means for bonding the patch to the film are an adhesive or seal.

6. The combination according to claim 1, wherein the manual grasping means are a portion of a part of the patch which is not bonded to the film or which is easily separated from the film.

7. The combination according to claim 6, wherein the second portion is adjacent to a free edge of the patch.

8. The combination according to claim 6, wherein the first and second portions are joined to each other by a line that includes at least one portion close to said separation means and at least one portion remote therefrom.

9. The combination according to claim 6, wherein each of the two parts of the patch includes at least a first portion adjacent to the separation means and bonded to the film, and a second portion adjacent to the first portion and spaced apart from the separation means, said second portion not being bonded to the film or being easily separable from the film and being suitable for being moved away therefrom to enable it to be grasped by the user.

10. The combination according to claim 1, wherein the patch is substantially symmetrical on either side of the separation means, each of its two parts including manual grasping means.

11. The combination according to claim 1, wherein the line of weakness of the film is made by sealing or by adhesive.

12. The combination according to claim 1, wherein the patch is made of or from paper, card, or plastics material.

13. The combination according to claim 1, wherein the patch comprises a single part prior to the separation means being activated.

14. A package comprising contents packaged by the combination according to claim 1.

15. The package according to claim 14, in which the film is placed over the contents with tension.

16. The combination according to claim 1, wherein each part comprises two portions, namely a first portion adjacent to the separation means which is provided with bonding means bonding the first portion to the film, and a second portion adjacent to the first portion and to a free edge of the patch, having no such means for bonding it to the film or being bonded to the film while remaining easily separable therefrom.

17. An easy opening device with a flexible film, serving as packaging, having a line of weakness in tearing, the device comprising a patch that is flexible and substantially inextensible and is in the form of a label, which patch is in two parts which are symmetrical and placed symmetrically about the line of weakness and that are fixed to an outside face of the film, the two parts being normally inactive when the packaging is closed, and being made active by the user exerting sufficient pulling force; means for bonding the film to each of the two parts of the patch on either side of the line of weakness and manual grasping means for moving the two parts apart and thus opening the packaging.

* * * * *